US006120965A

United States Patent [19]

Zhao et al.

[11] Patent Number: 6,120,965

[45] Date of Patent: Sep. 19, 2000

[54] EFFICIENT CONTACT TRANSFER OF LIQUID IMMERSION DEVELOPED IMAGES USING AN OVERLAYER

[75] Inventors: Weizhong Zhao, Webster; Chu-heng Liu, Penfield, both of N.Y.

[73] Assignee: Xerox Corporation, Stamford, Conn.

[21] Appl. No.: 09/232,816

[22] Filed: Jan. 19, 1999

[51] Int. Cl.[7] ..... G03G 13/16

[52] U.S. Cl. ..... 430/126

[58] Field of Search ..... 430/126, 106

[56] References Cited

U.S. PATENT DOCUMENTS

| | | | |
|---|---|---|---|
| 2,995,085 | 8/1961 | Walkup | 430/126 |
| 3,275,436 | 9/1966 | Mayer | 430/126 |
| 3,716,360 | 2/1973 | Fukushima et al. | 430/126 |
| 5,567,565 | 10/1996 | Larson et al. . | |
| 5,576,818 | 11/1996 | Badesha et al. . | |
| 5,585,905 | 12/1996 | Mammino et al. . | |
| 5,700,612 | 12/1997 | Kato et al. | 430/126 |
| 5,789,134 | 8/1998 | Brault et al. | 430/126 |
| 5,800,655 | 9/1998 | Tokuchi | 430/126 |

*Primary Examiner*—John Goodrow
*Attorney, Agent, or Firm*—Oliff & Berridge, PLC

[57] ABSTRACT

The methods and systems for efficiently transferring images from an image bearing member include placing an overlayer over a toner layer after placing the toner layer over the image bearing member. The overlayer reduces the adhesiveness of the toner layer to the image bearing member and, therefore, promotes efficient transfer to another substrate without applying heat. The overlayer also may have a higher cohesiveness and combine with the toner layer to increase the effective cohesiveness of the toner image to increase the efficiency of the transfer of the toner image. Overlayer materials include, by way of non-limiting example, a clear toner layer or a clear fluid layer.

28 Claims, 1 Drawing Sheet

EFFICIENT CONTACT TRANSFER OF LIQUID IMMERSION DEVELOPED IMAGES USING AN OVERLAYER

BACKGROUND OF THE INVENTION

1. Field of Invention

This invention is directed to contact transfer of liquid immersion developed images. More particularly, this invention is directed to highly efficient contact transfer of liquid immersion developed images using a cohesive and/or adhesive overlayer over the developed image.

2. Description of Related Art

In order to enable contact transfer of a toner image from a first substrate to a second substrate the toner image must exhibit a higher adhesiveness to the second substrate than to the first substrate and the toner image must also be cohesive enough to prevent the toner image from breaking or separating during the transfer.

Toner images comprise a carrier liquid and toner particles. The toner particles typically contain pigments as well as other materials such as charge control agents. These materials are bound in a resin. Depending upon the qualities of the carrier liquid and the resin, the toner particles may be dissolved in the carrier liquid by varying degrees. If the resin particles are dissolved to such an extent that the toner particle boundaries are not well defined, then the cohesiveness of the toner image tends to be relatively high. Additionally, as the ratio of toner particles to carrier fluid increases the cohesiveness of the toner image also increases. The toner particles tend to combine or interact more with each other as the relative content of the toner particles increases.

Liquid immersion developed images have conventionally been transferred using electrostatic transfer or transfuse methods. Electrostatic transfer processes overcome the adhesiveness of the toner image to the first substrate by applying a voltage differential between the second substrate and the toner image. Typically, the voltage differential is on the order of 800 Volts. However, process control of electrostatic transfer is very narrow. In particular, solid content, developed mass per unit area, substrate range and other factors which affect the efficiency of the transfer are difficult to control. Additionally, transfer quality using electrostatic transfer is difficult to maintain.

Electrostatic transfer processes also often involve coating the paper with carrier fluid. The layer of carrier fluid smoothes the surface of the paper to prevent air becoming trapped beneath the toner image. However, it is very difficult to remove the carrier fluid from the paper. Electrostatic transfer without coating the paper with carrier fluid has been ineffective because of the breakdown of the voltages in the air that is trapped in the paper.

At ambient temperature, toners that are typically used for transfuse processes tend to have resin particles that have distinct boundaries and are not dissolved in the carrier fluid. Thus, the cohesiveness of the toner at ambient temperature is relatively low. Transfuse processes heat the toner image above the melting or solvating point of the resin particles. Above this temperature, the resin particles tend to dissolve into the carrier liquid and mix with adjacent resin particles and the cohesiveness of the toner is greatly increased.

While transfuse and/or transfixing processes result in a higher quality image than electrostatic transfer, because the transfuse process requires heat, many problems are encountered in controlling the effects of the heat. For example, registration is problematic because the dimensions of the components of a system vary due to the thermal expansions and contractions that result from heating and cooling the system components. Additionally, transfixing requires generating heat and controllably dissipating the heat, which requires additional processing time and/or elaborate heat transfer systems. Additionally, other processes may not be usable with a transfix method because these other processes may not react well to the heat.

Conventional systems for contact transfer of toner images require a substrate with a low surface energy. The low surface energy substrate does not adhere well to the toner image. Therefore, the toner image is relatively more adhesive to another substrate than to the first substrate. Examples of low surface energy substrates are described in U.S. Pat. Nos. 5,567,565, 5,576,818, and 5,585,905, each incorporated herein by reference in its entirety.

Low surface energy refers to a surface of a solid which has a low interfacial free energy between the image bearing member and the developed image. A low interfacial free energy means that the solid will not adhere well to the image. Therefore, it will be easier to transfer the image to a new substrate. The low surface energy provides an adhesion to a liquid immersion developed image that is weaker than the internal cohesion of the developed image and the adhesion of the developed image to another substrate.

Typical image developing systems have two transfers. In the first transfer, these systems rely upon a strong electrostatic transfer process to move the toner image from a first substrate with a high surface energy such as a photoreceptor body to a second substrate such as an intermediate image bearing member having a low surface energy. The intermediate image bearing member enables the use of an electrostatic transfer process because the high voltages do not adversely affect the intermediate image bearing member. Additionally, the intermediate image bearing member does not adversely affect the electrostatic transfer voltages like the recording paper described above.

Next, the toner image is transfixed from the intermediate image bearing member to a recording media such as paper. Because the intermediate image bearing member is a low surface energy substrate, the toner image adheres to the recording media better than it adheres to the intermediate image bearing member. Additionally, the toner image is cohesive enough to prevent separation of the toner image because the image has been transfixed through the application of heat.

SUMMARY OF THE INVENTION

Efficient contact transfer of a toner image from a first substrate to a second substrate without the assistance of an electrostatic field or heat has not yet been possible. Efficient contact transfer requires that the toner image must adhere better to the second substrate than to the first substrate and the toner image must also be cohesive enough to prevent separation of the image. However, many liquid toners do not have material properties that meet these requirements because other subsystems such as development, cleaning and replenishment systems require toners with conflicting material properties. One typical example is a toner image that is not too adhesive to the first substrate but is not cohesive enough to prevent separation.

This invention provides methods and systems that efficiently transfer liquid immersion developed images using an overlayer. The overlayer reduces the adhesive and/or cohesive properties that is required of the toner image. The cohesiveness of the overlayer compensates for a low cohesiveness in the toner image. The overlayer may also compensate for an insufficent difference between the adhesiveness of the toner image to the second substrate and to the first substrate. The adhesiveness of the overlayer to the second substrate and to the toner image is greater than the adhesiveness of the toner image to the first substrate.

This invention also provides systems and methods for tranferring liquid immersion developed images that can replace the transfer mechanisms in conventional image developing systems.

This invention separately provides methods and systems that develop a latent image with an ink and that apply a cohesive and adhesive overlayer over the developed image to enable transfer without the use of heat and without requiring the use of electrostatic transfer processes. The methods and systems of this invention are effective for temperatures below the melting or solvating point of the resin in the toner particles.

Liquid immersion developed images adhere well to high surface energy image bearing members. The methods and systems for transferring liquid immersion developed images of this invention are particularly useful for transferring images from high surface energy image bearing members. Thus, the need for a low surface energy substrate is obviated when using the methods and systems of this invention.

The overlayer that is placed over the developed image is clear and combines with the toner image to increase the adhesiveness of the toner image to the second substrate. The overlayer also combines with the toner image to increase the overall cohesiveness of the toner image/overlayer combination over the toner image by itself. Thus, even if the developed image may not be contact transferable by itself, the overlayer enables the developed image to have a high cohesiveness and a high adhesiveness.

In one exemplary embodiment of the systems and methods of this invention, the overlayer penetrates the toner image and picks up the toner in the developed image. The overlayer also reduces constraints on the image bearing member and on the ink used in the contact transfer process. The image bearing member does not have to be a low surface energy image bearing member and the developing toner does not have to have a high cohesiveness and a high adhesiveness.

These and other features and advantages are described in or are apparent from the following detailed description of the preferred embodiments.

BRIEF DESCRIPTION OF THE DRAWINGS

The invention will be described in detail with reference to the following drawings in which like reference numerals refer to like elements and wherein.

DETAILED DESCRIPTION OF PREFERRED EMBODIMENTS

Figure 1:
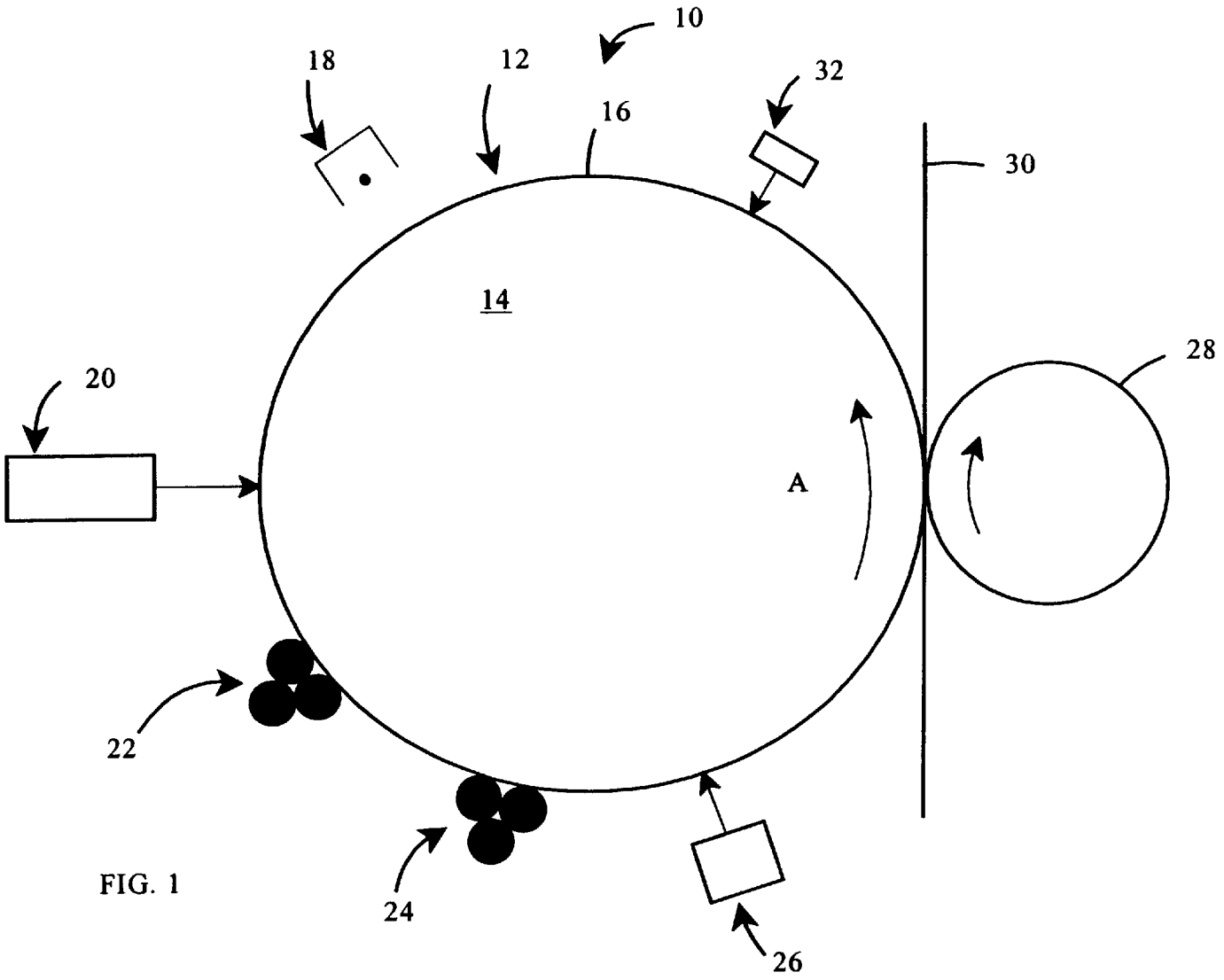
FIG. 1 is a schematic diagram of an image forming device in accordance with an embodiment of the invention.

The methods and systems of the invention apply an overlayer to increase the adhesiveness of the developed image to the next substrate and/or to increase the effective cohesiveness of the developed image, so that the image will transfer efficiently to the next substrate.

In one exemplary embodiment of the systems and methods of this invention, transferring this image may be aided by an electrostatic field. In this exemplary embodiment, an electrostatic bias is applied between the image bearing member and the next substrate. This bias assists the transfer because the developed image is charged. Therefore, the developed image is attracted to the next substrate because of this charge. However, the electrostatic voltage differential does not need to be as high as is necessary for conventional electrostatic transfer systems which do not use an overlayer in accordance with this invention.

FIG. 1 shows one exemplary embodiment of an image forming device 10 according to this invention. The image forming device 10 includes a drum 12 having an electrically grounded conductive substrate 14. A photoconductive layer 16 is provided over the electrically grounded substrate 14. Processing stations are positioned about the drum 12, such that, as the drum 12 rotates in a direction of arrow A, the drum 12 transports a portion of the photoconductive surface of the photoconductive layer 16 sequentially through each of the processing stations. The drum 12 is driven at a predetermined speed relative to the other machine operating mechanisms by a drive motor (not shown). Timing detectors (not shown) sense the rotation of the drum 12 and communicate with a control system (not shown) to synchronize the various operations of the image forming device, so that the proper sequence of operations is produced at each of the respective processing stations. In an alternative exemplary embodiment, a photoreceptor belt may be used as the image forming device 10 instead of the drum 12. In general, any known or later developed photoreceptor device or structure may be used in place of the drum 12.

Initially, the drum 12 rotates the photoconductive layer 16 past a charging station 18. The charging station 18 may, for example, be a corona generating device. The charging station 18 sprays ions onto the photoconductive surface of the photoconductive layer 16 to produce a relatively high, substantially uniform charge on the photoconductive layer 16. As known in the art, the photoconductive layer 16 must be of sufficient thickness and dielectric constant to have sufficient capacitance to develop the image-wise charge to a sufficient optical density.

Once the photoconductive layer 16 is charged, the drum 12 rotates to an exposure station 20, where a light image of an original image is projected onto the charged photoconductive surface of the photoconductive layer 16 to form a latent image on the photoconductive surface of the photoconductive layer 16. The exposure station 20 may include a raster output scanner or any other known or later developed system or apparatus for forming a latent image on the photoconductive surface of the photoconductive layer 16. For example, the latent image may be formed by other means, such as by ion beams or the like.

As the drum 12 continues rotating, the drum 12 rotates the latent image formed on the photoconductive surface of the photoconductive layer 16 to a developer bath station 22. In the developer bath station 22, a liquid developer is applied to the latent image. Pigment particles in the liquid developer are attracted to the latent image on the photoconductive surface of the photoconductive layer 16. The particles move through the carrier liquid in an image-wise manner to the latent image formed on the photoconductive surface of the photoconductive layer 16.

Following the developer bath station 22, the photoconductive layer 16 rotates to an overlayer applying station 24. The overlayer applying station 24 applies an overlayer over the developed image. The overlayer increases the overall effective cohesiveness of the developed image and/or increases the adhesiveness of the developed image to the second substrate. Examples of a material for the overlayer include an adhesive material and/or a clear contact transferable toner layer that is compatible with the developed image.

Optionally, the photoconductive layer 16 rotates to a conditioning station 26 that conditions the developed image and/or the overlayer. Conditioning prepares the developed image and/or the overlayer for contact transfer to another substrate at room temperature. The conditioning station 26 conditions the overlayer to cause the overlayer to penetrate the developed toner image, to increase the adhesiveness of the overlayer and/or to increase the cohesiveness of the developed image/overlayer. Examples of overlayer conditioning techniques include photochemically cross-linking or curing the overlayer, electrochemically treating the overlayer, chemically curing and/or cross-linking the overlayer, and/or removing fluid to increase the solid content of the overlayer. However, any known or later developed overlayer conditioning technique can be used with the systems and methods of this invention.

The drum 12 continues rotating to a transfer station having a conductive pressure roller 28, which may have a surface of conductive rubber or the like. A copy sheet 30 also advances into the transfer station. The pressure roller 28 applies pressure to the copy sheet 30 to press the copy sheet 30 against the developed image and overlayer on the drum surface 12. While the copy sheet 30 proceeds between the pressure roller 28 and the drum 12, a voltage potential may be applied, as known in the art. The voltage bias applied to the pressure roller 28 further encourages the image and overlayer to transfer to the copy sheet 30. The combination of the pressure between the pressure roller 28 and the drum 12, the adhesiveness and the cohesiveness of the overlayer causes the developed image to transfer from the surface of the drum 12 to the copy sheet surface.

Since, generally, less than all of the toner particles on the drum surface forming the developed image are transferred to the copy sheet 30, the drum 12 rotates to a cleaning station 32, where a doctor blade or the like may be provided to remove any two particles still adhering to the drum 12. This cleans the surface of the drum 12, so that subsequent images may be formed.

It should be appreciated that the image forming device 10 can be an image output terminal of an analog photocopier, a digital photocopier or a laser printer. The image forming device 10 can also be used as an image forming engine of a facsimile machine, a raster-output-scanner-type laser printer or photocopier, a page-width printbar-type laser printer or photocopier, or the like. In general, the image forming device 10 can be used with any known or later developed device that needs to form an image.

While the above detailed description described a photoreceptor drum as the first substrate, it should be understood that the methods and systems of the invention are useful for contact transfer from many different types of image bearing members, such as an imaging member, an intermediate transfer member or any other known or later developed image bearing member.

While this invention has been described in conjunction with the specific embodiments outlined above, it is evident that many alternatives, modifications and variations are apparent to those skilled in the art. Accordingly, the preferred embodiments of the invention as set forth above are intended to be illustrative and not limiting. Various changes may be made without departing from the spirit and scope of the invention.

What is claimed is:

1. A method for contact transferring a toner layer from an image bearing member to a substrate, comprising:

placing a toner layer over the image bearing member to form a toner image that has ineffective contact transfer properties;

placing an overlayer over the toner layer, the overlayer having at least one of increased cohesiveness and increased adhesiveness over that of the toner layer; and pressing the substrate against the image bearing member to transfer the overlayer and the toner layer from the image bearing member to the substrate.

2. The method of claim 1, wherein the overlayer has a higher cohesiveness than the toner layer.

3. The method of claim 1, wherein the overlayer is more adhesive than the toner layer.

4. The method of claim 1, further comprising forming a latent image over the image bearing member, wherein placing the toner layer over the image bearing member comprises developing the latent image.

5. The method of claim 1, further comprising conditioning the overlayer before pressing the substrate against the image bearing member.

6. The method of claim 5, wherein conditioning the overlayer comprises photo-chemically conditioning the overlayer.

7. The method of claim 5, wherein conditioning the overlayer comprises electrochemically conditioning the overlayer.

8. The method of claim 5, wherein conditioning the overlayer comprises chemically conditioning the overlayer.

9. The method of claim 5, wherein:

the overlayer comprises an overlayer material suspended in a carrier liquid; and conditioning the overlayer comprises removing carrier liquid from the overlayer.

10. The method of claim 5, further comprising, in response to conditioning the overlayer, increasing an internal cohesion of the overlayer.

11. The method of claim 5, further comprising, in response to conditioning the overlayer, increasing an adhesiveness of the overlayer.

12. The method of claim 1, wherein the overlayer comprises a clear toner layer.

13. The method of claim 1, wherein the overlayer comprises a clear fluid layer.

14. The method of claim 1, further comprising, in response to placing the overlayer over the toner layer, increasing an internal cohesion of the toner layer.

15. The method of claim 1, further comprising, in response to placing an overlayer over the toner layer, increasing an adhesiveness of the toner layer.

16. The method of claim 1, further comprising forming the toner layer over a photoreceptor, wherein placing the toner layer over the image bearing member comprises transferring the toner layer from the photoreceptor to the image bearing member.

17. An image forming system comprising:

an image bearing member;

a toner layer applicator that is capable of placing a toner layer over the image bearing member to form a toner image that has ineffective contact transfer properties;

an overlayer applicator that is capable of applying an overlayer over the toner layer, the overlayer having at least one of increased cohesiveness and increased adhesiveness over that of the toner layer; and a transfer station that is capable of transferring the toner image and the overlayer to a substrate by pressing the substrate against the image bearing member, wherein the overlayer increases at least one of an internal cohesiveness of the toner layer and an adhesiveness of the toner layer to the substrate.

18. The image forming system of claim 17, further comprising an image-wise exposing system for generating a latent image over the image bearing member, wherein the toner layer applicator is a latent image developing device.

19. The image forming system of claim 17, further comprising an overlayer conditioner.

20. The image forming system of claim 19, wherein the overlayer conditioner chemically conditions the overlayer.

21. The image forming system of claim 19, wherein the overlayer conditioner photo-chemically conditions the overlayer.

22. The image forming system of claim 19, wherein the overlayer conditioner electrochemically conditions the overlayer.

23. The image forming system of claim 19, wherein:

the overlayer comprises an overlayer material suspended in a carrier liquid; and the overlayer conditioner comprising a fluid removal system that removes carrier liquid from the overlayer.

24. The image forming system of claim 19, wherein, in response to the overlayer conditioner conditioning the overlayer, an internal cohesion of the overlayer increases.

25. The image forming system of claim 19, wherein, in response to the overlayer conditioner conditioning the overlayer, an adhesiveness of the overlayer increases.

26. The image forming system of claim 17, wherein the overlayer comprises a clear toner layer.

27. The image forming system of claim 17, wherein the overlayer comprises a clear fluid layer.

28. The image forming system of claim 17, further comprising a photoreceptor that is capable of forming the toner layer, wherein:

the image bearing member is an intermediate transfer member; and the toner layer applicator is a transfer device that is capable of transferring the toner layer from the photoreceptor to the image bearing member.

* * * * *